US009170020B2

(12) United States Patent
Diebold et al.

(10) Patent No.: US 9,170,020 B2
(45) Date of Patent: Oct. 27, 2015

(54) MONITORING OF THE PRESENCE OF TWO FLAMES IN A FUEL COMBUSTION DEVICE

(75) Inventors: Alexander Diebold, Rastatt (DE); Ulrich Hofmann, Oetigheim (DE); Erik Lang, Ettlingen (DE); Josef Lelle, Baden-Baden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 848 days.

(21) Appl. No.: 13/462,377

(22) Filed: May 2, 2012

(65) Prior Publication Data

US 2012/0280134 A1 Nov. 8, 2012

(30) Foreign Application Priority Data

May 2, 2011 (EP) ..... 11164502

(51) Int. Cl.
*F23N 5/24* (2006.01)
*F23N 5/08* (2006.01)

(52) U.S. Cl.
CPC ..... *F23N 5/082* (2013.01); *F23N 5/242* (2013.01); *F23N 5/08* (2013.01); *F23N 2029/00* (2013.01); *F23N 2029/02* (2013.01); *F23N 2029/04* (2013.01); *F23N 2029/14* (2013.01); *F23N 2029/16* (2013.01)

(58) Field of Classification Search
CPC ..... F23N 2029/00; F23N 2029/02; F23N 2029/04; F23N 2029/14; F23N 2029/16; F23N 5/08; F23N 5/082; F23N 5/242
See application file for complete search history.

(56) References Cited

U.S. PATENT DOCUMENTS

| | | | | |
|---|---|---|---|---|
| 3,384,439 | A * | 5/1968 | Walbridge | 431/24 |
| 3,548,395 | A | 12/1970 | Gilbert | |
| 3,674,410 | A * | 7/1972 | Wade | 431/74 |
| 3,737,664 | A | 6/1973 | Oldenburg et al. | |
| 2003/0234582 | A1 | 12/2003 | Orloff | |
| 2009/0219655 | A1 * | 9/2009 | Korolyov et al. | 361/42 |

FOREIGN PATENT DOCUMENTS

| | | |
|---|---|---|
| DE | 1267776 | 5/1968 |
| EP | 0334027 | 9/1989 |
| EP | 11164502 | 5/2012 |

OTHER PUBLICATIONS

European Search Report for related European Application No. 11164502.4, issued Nov. 24, 2011, 4 pages.
European Notification of Grant for related European Application No. 11164502.4, issued Oct. 22, 2013, 45 pages.

* cited by examiner

*Primary Examiner* — Mark R Gaworecki
(74) *Attorney, Agent, or Firm* — Staas & Halsey LLP

(57) ABSTRACT

A monitoring device has a first flame detector, to receive a first batch of radiation, which is emitted by the first flame, a second flame detector, to receive a second batch of radiation, which is emitted by the second flame, a voltage supplying device to apply an alternating voltage with a first half wave and a second half wave to the two flame detectors and an evaluation circuit that is connected to the two flame detectors via a signal input. A first measurement signal that is present at the common signal input during the first half wave is indicative of the intensity of the first batch of radiation. A second measurement signal that is present at the common signal input during the second half wave is indicative of the intensity of the second batch of radiation. The evaluation circuit independently evaluates the first measurement signal and the second measurement signal.

12 Claims, 3 Drawing Sheets

MONITORING OF THE PRESENCE OF TWO FLAMES IN A FUEL COMBUSTION DEVICE

CROSS REFERENCE TO RELATED APPLICATIONS

This application is based on and hereby claims priority to European Application No. 11164502 filed on May 2, 2011, the contents of which are hereby incorporated by reference.

BACKGROUND

The present invention relates to a monitoring device and a method for the independent monitoring of the presence of a first flame and of a second flame in such a fuel combustion device.

Fuel combustion devices are used in, among other things, heating and/or hot water engineering and in industrial thermoprocessing equipment employed, for example, in the smelting of metals or the firing of ceramics. Fuel combustion devices which are used in heating and/or hot water engineering and are contained in boilers or continuous flow water heaters do not normally only operate with a main flame, for actual heat generation, but also have a second, so-called pilot flame, which is also called an ignition flame. In this document, fuel burning devices which are also described as burner automats, fuel burners or simply burners can, for example, be gas burners or oil burners.

In many types of burner, the pilot flame does not go out even when no heat output is required. The purpose of the pilot flame is thus only to assure rapid ignition of the main flame when a fuel valve assigned to the main flame is opened. In other types of burner the pilot flame is extinguished in the interim and is only reignited shortly before the main flame ignites, for example by an electric ignition. When the main flame is activated, the burning pilot flame ensures that the main flame ignition process can take place in a controlled and ordered manner.

For reasons of operational reliability, relevant standards state that it must be possible to detect the presence of the main and/or the pilot flame independently of one another.

The use of a UV detector for monitoring the presence of both a pilot flame and a main flame is known from technical research documentation such as "Flammenüberwachung an Öl-und Gasbrennern", Siemens Building Technologies, CC1Z7302de, HVAC Products, 16.02.2005. A UV detector of this kind, which is also called a UV flame sensor, is formed of a series circuit made up of ohmic resistance, a UV cell and a diode.

The UV cell of the UV detector has a glass flask made of UV-permeable quartz glass and filled with noble gas. In the glass flask are two electrodes. If voltage is applied between the two electrodes and this voltage is increased, then when a critical voltage is reached, glow discharge (ignition) takes place. Electrons are emitted from the negative electrode, are accelerated toward the positive electrode and ionize the noble gas. This results in a flow of current through the UV cell. The UV cells used for flame monitoring typically exhibit this behavior of self-ignition only at voltages of more than 700 V. UV cells behave differently if they are irradiated by the flame being monitored with UV light of which the wavelength is approx. 190 to 260 nm: in such cases, occurrence of the ignition effect depends on the intensity of the UV radiation at effective voltages as low as approx. 200 V.

The diode of the UV detector assures half-wave rectification, so that if the UV detector is operating with an alternating voltage when a flame is present a pulsed direct voltage is generated. In the event of a short circuit in the connection cables of the UV detector it, and thus also the diode, is bypassed, with the result that when the UV detector is operating with an alternating voltage, alternating voltage is generated instead of the pulsed direct voltage, including at the input of an amplifier circuit downstream from the UV detector. In this way, the presence of a flame is indicated by a pulsed direct voltage and a cable short circuit is indicated by an alternating voltage.

Monitoring the main flame and the pilot flame independently of one another using a UV detector in each case has the disadvantage that (a) a connection cable (with two connection wires) and (b) an amplifier circuit are needed for each of the two UV detectors. Monitoring the main flame and the pilot flame using a UV detector in each case is thus relatively apparatus-intensive.

SUMMARY

As regards the complexity of the apparatus required, it is one potential object to simplify the process of independently monitoring two spatially separate flames using a flame detector in each case.

The inventors propose a monitoring device for the independent monitoring of the presence of a first flame and of a second flame in a fuel combustion device. The monitoring device has (a) a first flame detector configured and arranged to receive a first batch of radiation, which is emitted by the first flame, (b) a second flame detector, configured and arranged to receive a second batch of radiation, which is emitted by the second flame, (c) a voltage supplying device that is connected to the two flame detectors and is configured to apply an alternating voltage with a first half wave and a second half wave to the two flame detectors and (d) an evaluation circuit that is connected to the two flame detectors via a common signal input. The two flame detectors are configured in such a way, and are wired in such a way in relation to the voltage supplying device and to the evaluation circuit that a first measurement signal that is present at the common signal input during the first half wave is indicative of the intensity of the first batch of radiation and a second measurement signal that is present at the common signal input during the second half wave is indicative of the intensity of the second batch of radiation. In addition, the evaluation circuit is configured to evaluate the first measurement signal and the second measurement signal independently of one another.

The monitoring device described is based on the finding that if the two flame detectors are suitably wired then, despite the use of a common signal input, the two flame detectors can be read independently of one another, provided the first measurement signal is assigned exclusively to the first flame detector and the second measurement signal is assigned exclusively to the second flame detector. In such cases, the first measurement signal can only occur during the first half wave of alternating voltage applied to both flame detectors. Accordingly, the second measurement signal can only occur during the second half wave of alternating voltage.

In simple terms, this means that the measurement signals of the two flame detectors are assigned to the first (pilot) flame or the second (main) flame on the evaluation circuit by separating the signals, taking account of both the positive and the negative half wave. This enables the intensities of the two flames to be evaluated separately in a simple yet effective manner.

The fuel combustion device can be any desired burner that is used in heating and/or hot water engineering in particular. The fuel burned can be solid, liquid or gaseous under normal conditions. The monitoring device described currently appears to be particularly suitable for burners that burn gas or in some cases also oil.

The monitoring device described has the advantage over known flame monitoring devices that when only one flame monitor to which both flame detectors are connected is used which, in addition to a display device, has the voltage supplying device and the evaluation circuit described, the presence of each of the two flames can be monitored independently. Efficient monitoring of both a main flame and a pilot flame in a fuel combustion device can thus be achieved in a manner which is not apparatus-intensive. An additional connector on the flame monitor, for connecting the second flame detector, is not necessary, and only a two-wire flame detector connection lead is required for bridging the gap between the actual fuel burning device in which the two flames are burning and a switch cabinet in which, typically, the flame monitor is arranged.

It should be pointed out that the two flames mentioned can also be two of the flames in a so-called surface burner, which typically has multiple individual flames, each one of which is assigned to at least one opening in a fuel line. Normally, when the surface burners ignite, one flame is ignited, which then ignites the fuel that is issuing from the adjacent openings. In this way, each of the individual flames is ignited in turn. The fuel line can, for example, be in serpentine form, in order to cover a predefined surface area.

According to one exemplary embodiment the monitoring device also has (a) a common voltage supply line that connects the voltage supplying device to both the first flame detector and the second flame detector and/or (b) a common measurement signal line that connects both the first flame detector and the second detector to the common signal input of the evaluation circuit.

The use of a common, in particular a single-wire (connection) lead to supply the voltage for the two flame detectors and/or a common, in particular a single-wire (connection) lead for the onward transmission to the evaluation circuit for measurement signals generated by the two flame detectors has the advantage that a single connection lead is in each case sufficient to connect the two flame detectors to the voltage supply and/or to the evaluation circuit. This advantageously reduces the number of cables required between the voltage supplying device and the two flame detectors and/or the number of cables required between the two flame detectors and the common signal input.

It should be pointed out that the common voltage supply line connects one connection on each of the two flame detectors to the voltage supplying device, while the common measurement signal line connects the other connection on each of the two flame detectors to the common signal input of the evaluation circuit.

According to another exemplary embodiment the first flame detector has a first electrically rectifying element and the second flame detector has a second electrically rectifying element, it being possible for the two rectifying elements to be wired antiparallel in relation to the voltage supplying device and to the common signal input. This has the advantage that the two half waves of alternating voltage, both of which are adjacent to the two flame detectors, can be easily and effectively separated between the two flame detectors. The result is that, with each of the flame detectors, only one half wave of alternating voltage supply generates a measurement signal that can be detected and evaluated as a positive or a negative half-wave signal by the evaluation circuit, independently of the other half-wave signal in each case.

If a minor adjustment is made to a known evaluation circuit such as the flame signal amplifier LME7 or Siemens' LMV flame signal amplifier it is possible for the two (half-wave) measurement signals to be evaluated separately. It is, for example, possible here for another amplifier circuit to be provided, so that a separate amplifier circuit is used for each of the two (half-wave) measurement signals.

The rectifying element can be a valve, and is preferably a diode made, for example, of a semiconductor material.

According to another exemplary embodiment, the first flame detector also has a first radiation detector and the second flame detector also has a second radiation detector, and at least one of the two radiation detectors is sensitive to electromagnetic radiation in the region of the ultraviolet spectral range. This has the advantage that the presence of at least one flame is detected on the basis of the proportion of UV in the electromagnetic emission spectrum of the flame. In this way, the influence of disturbance in the region of the visible, or infrared, spectral range can be effectively eliminated.

The radiation detector that is sensitive in the ultraviolet spectral range can, for example, be the abovementioned UV cell with a glass flask, made of UV-permeable quartz, in which there are two electrodes. The glass flask also contains a noble gas, which is ionized by UV radiation striking it, so that the UV cell becomes at least partially electrically conducting. Such a UV cell is particularly sensitive to radiation in the electromagnetic spectral range of between 200 nm and 260 nm.

It should be pointed out that it is preferable for both radiation detectors to be sensitive to electromagnetic radiation in the ultraviolet spectral range. It should also be pointed out that despite the current preference for using radiation detectors that are of the same kind, it is also possible to use a combination of different kinds of radiation detector, and in particular of radiation detectors that are sensitive in the ultraviolet spectral range.

According to another exemplary embodiment the evaluation circuit has a filter circuit. This has the advantage that the (half-wave) measurement signals of the two flame detectors are evened out in such a way that, instead of a pulsed direct voltage signal, an evened-out direct voltage signal can in each case continue to be processed on the evaluation circuit. Preferably, the filter circuit can be connected immediately downstream from the signal input.

The filter circuit can, for example, be a so-called RC filter circuit with one or more RC links, each of which has a resistance and a capacitor.

According to another exemplary embodiment, the evaluation circuit has (a) a first amplifier circuit that is configured exclusively to amplify the first measurement signal, and (b) a second amplifier circuit that is configured exclusively to amplify the second measurement signal. This has the advantage that the two measurement signals can not only be detected independently of one another but also be amplified and evaluated independently of one another. Preferably, each of the two amplifier circuits has its own output, from which a signal, in particular a direct voltage signal that is indicative of the presence of the particular flame, is emitted.

According to another exemplary embodiment, the evaluation circuit has a data processing unit that is configured to detect the presence of a fault in an electronic component of the evaluation circuit and, in particular, to identify the faulty component, on the basis of a first output signal from the first amplifier circuit and of a second output signal from the second amplifier circuit. This has the advantage that it makes simple automated fault diagnosis on the evaluation circuit possible. This can considerably improve the operational reliability of the monitoring device as a whole.

According to another exemplary embodiment, the first amplifier circuit has a first diode on the input side and the second amplifier circuit has a second diode on the input side. In this embodiment, one of the two diodes is connected to the common signal input on the anode side and the other diode is connected to the common signal input on the cathode side.

The use of two diodes connected opposite one another makes it possible simply and efficiently to separate the two with measurement signals linked to various half waves, so that the first measurement signal is directed exclusively to the first amplifier circuit and the second measurement signal is directed exclusively to the second amplifier circuit.

It should be pointed out that the connection described, linking the anode and cathode to the common signal input, can be a direct connection or an indirect connection. If it is an indirect connection, at least one other electronic component is located between the anode or cathode and the common signal input. In particular, the filter circuit described above can be between the anode or the cathode and the common signal input.

According to another exemplary embodiment the first diode is a first Zener diode and/or the second diode is a second Zener diode.

It is known that in the forward direction, a Zener diode behaves like a normal diode. In the monitoring device described, normal behavior ensures that the two measurement signals are separated from one another and that each is directed to one of the two amplifier circuits. If, however, voltage that is greater than the specific breakdown voltage for the Zener diode in question is applied in the reverse direction, the Zener diode becomes low-ohmic. In the monitoring device described, this behavior can, if the Zener diode is of a suitable size and, in particular, if a suitable breakdown voltage is chosen, be used to detect a short circuit in the connection lead, in particular a short circuit between the voltage supply line described above and the common measurement signal line described above.

According to another exemplary embodiment, the magnitude of the breakdown voltage of at least one of the two Zener diodes is such that the at least one Zener diode (a) is operated within a voltage range that is lower than the breakdown voltage if the connection of the two flame detectors to the voltage supplying device and to the common signal input is fault-free and (b) is operated within a voltage range that is higher than the breakdown voltage if a short circuit occurs between the voltage supplying device and the common signal input.

The voltage range mentioned, which is higher than the voltage in the reverse direction, is typically also described as the cutoff range. In this cutoff range, the Zener diode has lost its rectifying effect.

With the monitoring device described, if there is a short circuit, particularly between the common voltage supply line described above and the common measurement signal line described above, the Zener diode will be operating with the alternating voltage already supplied by the voltage supplying device, if necessary after evening-out by the filter circuit, also described above. As, when there is a short circuit, the Zener diode is operating with a higher alternating voltage—unlike during fault-free operation of the monitoring device, during which the relevant flame detector, even when radiation is detected, ensures that there is at least a certain drop in voltage—this short circuit can be detected on the basis of a very slight change in the alternating voltage—in some cases due to the characteristics of the Zener diode—that is fed into the relevant amplifier circuit and emitted at an output of the amplifier circuit. The presence of an output alternating voltage can thus be regarded as a reliable indicator that there is a short circuit, in particular between the common voltage supply line described above and the measurement signal line described above. Detection of a short circuit is thus not only made simple but also effective and reliable, and the operational reliability of the monitoring device as a whole is considerably increased.

It should be pointed out that the size of the drop in voltage via the flame detector depends to a large degree on the type of radiation detector used in the flame detector in question. If this is a UV cell, which is currently regarded as particularly suitable, the drop in voltage via the UV cell, even if comparatively high intensity of UV radiation is shown to exist, is in the region of 100 V. In the event of a short circuit, therefore, the voltage of the common signal input of the evaluation circuit is approx. 100 V higher. This increased voltage then results, in some cases following some voltage attenuation by the filter circuit described above, in the Zener diode in question being within its cutoff range, at least during one of the two half waves of alternating voltage. It is of course necessary to choose a Zener diode with a suitable typical breakdown voltage in order to detect the short circuit detection functionality described above on the basis of an alternating voltage output signal from the amplifier circuit in question.

The inventors also propose a method for the independent monitoring of the presence of a first flame and of a second flame in a fuel combustion device. The method described proposes (a) applying an alternating voltage supplied by a voltage supplying device with a first half wave and a second half wave to a first flame detector and a second flame detector, (b) receiving a first batch of radiation, which is emitted by the first flame, by the first flame detector, (c) receiving a second batch of radiation, which is emitted by the second flame, by the second flame detector, (d) directing a first measurement signal present during the first half wave from the first flame detector to a common signal input of an evaluation circuit, it being possible for the first measurement signal to be indicative of the intensity of the first batch of radiation, (e) directing a second measurement signal present during the second half wave from the second flame detector to the common signal input of the evaluation circuit, it being possible for the second measurement signal to be indicative of the intensity of the second batch of radiation, and (f) monitoring the presence of the first flame and of the second flame by the evaluation circuit, on the basis of the first measurement signal and the second measurement signal.

The method described is also based on the finding that if the two flame detectors are suitably wired then, despite the use of a common signal input, the two flame detectors can be read independently of one another, provided the first measurement signal can be assigned exclusively to the first flame detector and the second measurement signal can be assigned exclusively to the second flame detector. According to the proposals, this assignment takes place via the two half waves of the alternating voltage that is made available to both flame detectors by the voltage supplying device. In such cases, the first measurement signal can only occur during the first half wave of alternating voltage applied to both flame detectors. Accordingly, the second measurement signal can only occur during the second half wave of alternating voltage.

According to one exemplary embodiment, the method also proposes (g) extinguishing the first flame, (h) evaluating the first measurement signal and (i) considering the monitoring device to be faulty if the evaluation of the first measurement signal incorrectly indicates the presence of the first flame.

The at least temporary extinguishing of the first flame has the advantage that it enables the proper functioning of the monitoring device to be easily checked. In particular, a short circuit between the abovementioned common voltage supply line and the abovementioned common measurement signal line can be detected because only in the event of a short circuit of that kind is there an alternating current signal at the common signal input, even when the first flame detector is receiving no radiation at all.

The first flame can, for example, be extinguished by closing a valve regulating the fuel feed to the first flame. In such cases, however, at least some delay is to be expected in the evaluation of the first measurement signal, corresponding to the anticipated time lag between the closing of the valve and the actual extinguishing of the first flame. For example, this delay can be between 1 and 10 seconds, depending on the design of the fuel combustion device in question.

Advantageously, the first flame can be extinguished during so-called intermittent operation of the fuel combustion device, as it is then not necessary to turn off the first flame in a separate operation with the sole purpose of checking the working order of the monitoring device.

To comply with relevant product standards for fuel combustion devices, which can also be called "burner automats", the term "intermittent operation" should be understood to mean an operating mode in which the flames are switched off at least once (×1) every 24 hours. As far as normal heating applications for use in living areas are concerned, this requirement is in most cases met, as burners are often activated several times per hour. The fuel combustion device described can therefore use the activation process to check that it is in working order, and in particular to check its flame monitoring system. This ensures that the flame monitoring system is relatively frequently tested during intermittent operation.

It should be pointed out that the method described can also be implemented in the same way with the second flame.

It should also be pointed out that even in fuel combustion devices or burners in which at least one flame (the pilot flame) always remains on, a fault, in particular a short circuit, can still be detected. It is thus possible, for example, in the embodiment of the monitoring device described above, in which suitably sized Zener diodes are used in order, when there is a voltage breakdown in one of the half waves (in the other half wave, the Zener diode is the conducting diode in any case) and thus when alternating voltage is fed to the relevant amplifier circuit on the evaluation circuit, to detect a short circuit between the common voltage supply line and the common measurement signal line.

It should be pointed out that the embodiments are described in reference to various aspects of the method or the device. However, on reading this document, it will be immediately clear to those skilled in the art that, unless it is explicitly stated otherwise, method features have corresponding device features, and vice versa.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

It should be pointed out that features and components of various embodiments that are the same, or at least function in the same way, as the corresponding features or components of the embodiment in question have been given the same reference numbers, or a reference number that differs from the reference number of a (functionally) corresponding feature or a (functionally) corresponding component only in the first character of its reference number. To avoid unnecessary repetition, features or components already illustrated by a previously described embodiment will not be described in detail again at a later point.

It should also be pointed out that the embodiments described below only represent a limited selection of possible variants. In particular, certain appropriate combinations of the features of individual embodiments can be made, so it will be apparent to the person skilled in the art that numerous different embodiments are disclosed with the variants explicitly shown here.

Figure 1:
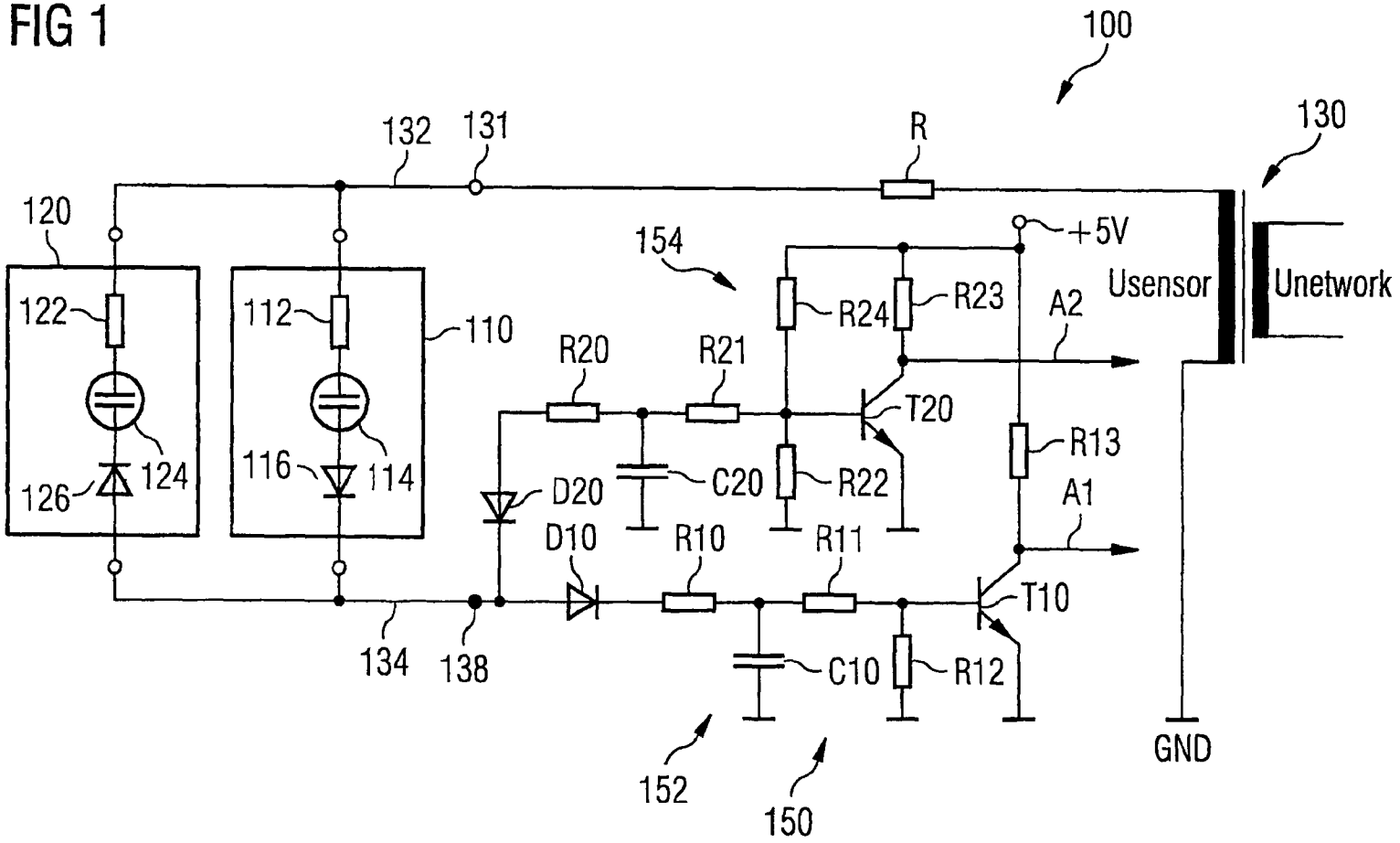
FIG. 1 shows a monitoring device according to a first exemplary embodiment, in which rectifying diodes are used to separate the measurement signals provided by two flame detectors.

FIG. 1 shows a monitoring device 100 according to a first exemplary embodiment. The monitoring device 100 has two flame detectors, a first flame detector 110 and a second flame detector 120. According to the exemplary embodiment shown here, the first flame detector 110 monitors the presence of a main flame in a fuel combustion device and the second flame detector 120 monitors the presence of a pilot flame in the fuel combustion device. As can be seen in FIG. 1, each of the two flame detectors 110, 120 has a resistance, 112 and 122 respectively, a radiation sensitive sensor element (such as a UV cell or photoelement), 114 and 124 respectively, and a rectifying diode, 116 and 126 respectively. The two diodes 116 and 126 are connected, antiparallel relative to one another, to a common measurement signal line 134.

Each of the two UV cells 114 and 124 has a glass flask made of a UV-permeable quartz glass and filled with noble gas. In the glass flask are two electrodes. If voltage is applied between the two electrodes and, in addition, the noble gas is irradiated with UV light emitted by the main flame or the pilot flame, then the UV cell in question becomes at least partially electrically conducting and a current can flow through the corresponding flame detector 110, 120.

The monitoring device 100 also has a voltage supplying device 130 which is configured as a transformer and arranged in a housing (not shown), and is connected to the two flame detectors 110 and 120 via a resistance R, a common voltage output 131 and a common voltage supply device 132. The common voltage output 131 is configured as connection contact 131 in the housing (not shown) of the monitoring device 100. According to the exemplary embodiment shown here, the transformer 130 performs a transformation during which a 50 Hz input signal with a network voltage (Unetwork) of 230 V is stepped up to a 50 Hz output signal with a sensor voltage (Usensor) of approx. 300 V. It should be pointed out that voltage transformations with other frequencies and/or with other primary and/or secondary voltage values are of course possible. For example, in the US, an input signal with an effective voltage of 120 V and a frequency of 60 Hz is normally used.

The monitoring device 100 also has an evaluation circuit 150 which, in turn, has a first amplifier circuit 152 and a second amplifier circuit 154. The first amplifier circuit 152 has a diode D10 on the input side that is connected to a common signal input 138. The second amplifier circuit 154 has a diode D20 on the input side that is connected to the common signal input 138. According to the exemplary embodiment shown here the common signal input is configured as connection contact 138 in the abovementioned housing (not shown).

As can be seen in FIG. 1, the two diodes 116 and D10 have the same "polarity" in relation to the common measurement signal line 134. This means that a voltage passing through the first flame detector 110 will be further processed exclusively by the first amplifier circuit 152. Accordingly, the two diodes 126 and D20 also have the same "polarity" in relation to the common measurement signal line 134. This means that a voltage passing through the second flame detector 120 will be further processed exclusively by the second amplifier circuit 154.

As an alternating voltage is applied to the two flame detectors 110 and 120 via the common voltage supply line 132, then the first flame detector 110 can, when the main flame is burning, only be electrically conducting during the positive half wave of alternating voltage, whereas the second flame detector 120 can only be conducting during the negative half wave of alternating voltage when the pilot flame is burning. The measurement signal from the two flame detectors 110 and 120 that is transferred to the evaluation circuit 150 via the common measurement signal line 134 is then separated from the two diodes D10 and D20 so that, as already described above, the first amplifier circuit 152 is assigned to the first flame detector 110 with the first output A1 and the second amplifier circuit 154 being assigned to the second flame detector 120 with a second output A2.

As can be seen from FIG. 1, the first amplifier circuit 152 has a first low-pass filter formed of a resistance R10 and a capacitor C10. Accordingly, the second amplifier circuit 154 has a second low-pass filter formed of a resistance R20 and a capacitor C20. These two filter circuits 152 and 154 have the effect of evening out the pulsed direct voltage adjacent to the filter input, so that, in good approximation, a direct voltage signal is emitted at the filter output in question. This direct voltage signal is then amplified by the respective amplifier circuit 152 or 154. As can be seen in FIG. 1, the first amplifier circuit 152 has three resistances R11, R12 and R13 and a bipolar transistor T10. The second amplifier circuit 154 has four resistances R21, R22, R23 and R24 and a bipolar transistor T20. According to the exemplary embodiment shown here, the two amplifier circuits 152 and 154 operate, as can be seen in FIG. 1, at two voltage levels, 5 V and 0 V (GND).

As such amplifier circuits are familiar to those skilled in the art, the way in which they function will not be explained in detail here. However, to those skilled in the art it will be immediately clear from the two amplifier circuits 152 and 154 shown in FIG. 1 that if the first flame detector 110 becomes at least partially conducting (the main flame is on), a logic level of approx. 0 V (Low) will be emitted at the first output A1. If the first flame detector 110 receives no UV radiation (the main flame is off), the first flame detector 110 performs a shutoff function and the logic level at the output A1 will be approx. 5 V (High). Due to the presence of the resistance R24, if the second flame detector 120 becomes at least partially conducting when it receives UV radiation (the pilot flame is on), a logic level of approx. 5 V (High) is emitted at the second output A2. If the second flame detector 120 receives no radiation (the pilot flame is off), the second flame detector 120 performs a shutoff function and a logic level of approx. 0 V (Low) will be emitted at the output A2. By evaluating the two voltage levels it is thus possible to monitor both the presence of the main flame assigned to the first flame detector 110 and the presence of the pilot flame assigned to the second flame detector. Because of the antiparallel arrangement of the flame detectors and despite the use of a common voltage supply line 132 and a common measurement signal line 134, it is possible for the measurement signals of the two flame detectors to be clearly assigned to the two flames and for the two flames to be independently monitored.

Figure 2:
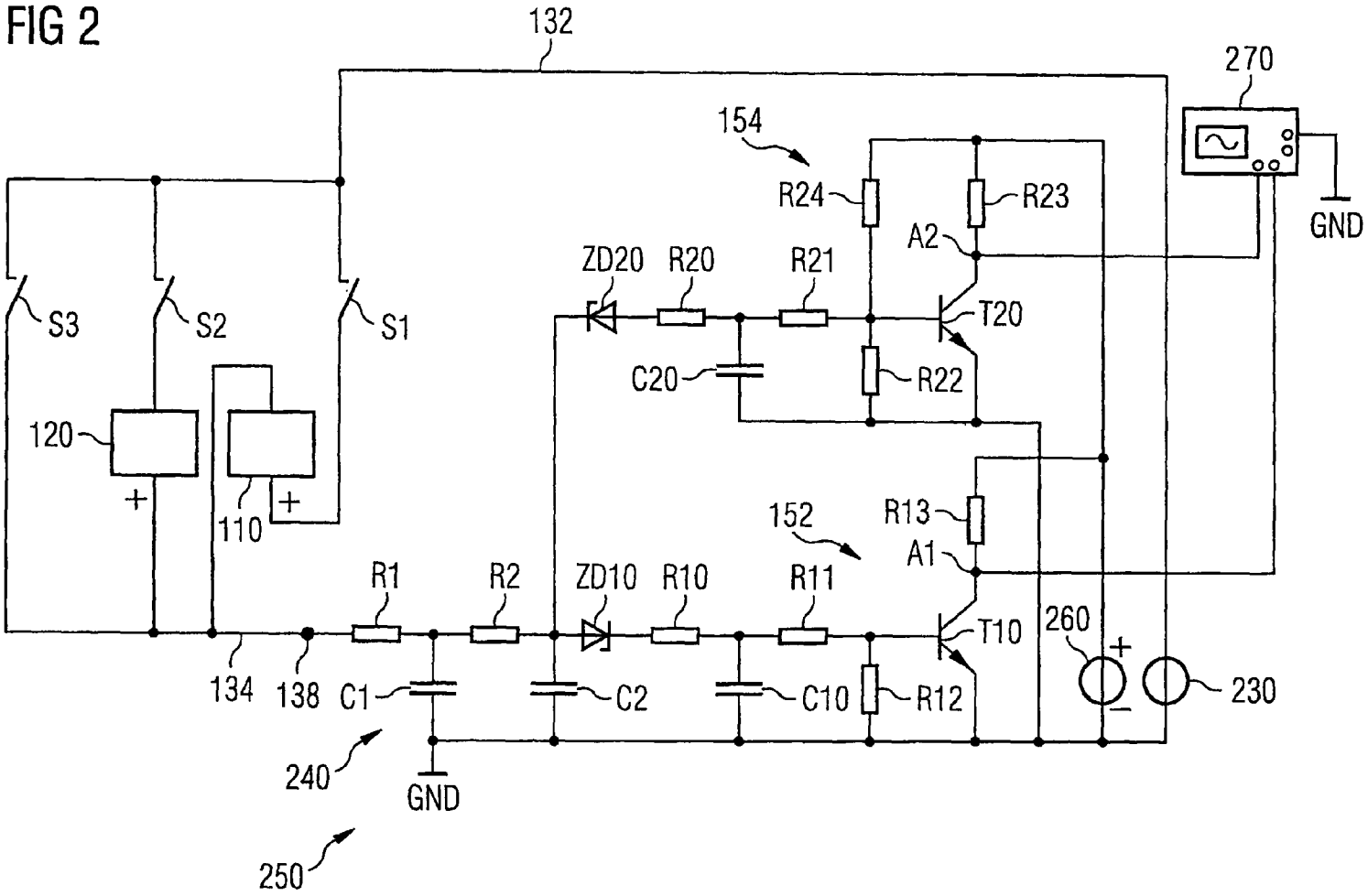
FIG. 2 shows a monitoring device according to a second exemplary embodiment, in which Zener diodes are used to separate the two measurement signals, so that a short circuit in the sensor can also be detected.

FIG. 2 shows a monitoring device 200 according to a second exemplary embodiment. The monitoring device 200 has a voltage supplying device 230 configured as an alternating voltage source and a direct voltage source 260. As can be seen by comparing FIGS. 1 and 2, an evaluation circuit 250 of the monitoring device 200 only differs from the evaluation circuit 150 shown in FIG. 1 in that (a) instead of the usual diodes D10 and D20, a Zener diode ZD10 or ZD20 is used in each case, and that (b) a two-stage low-pass filter circuit 240 is also provided, which has two resistances R1 and R2 and two capacitors C1 and C2. The separation (a) of the measurement signal from the first flame detector 110 and (b) of the measurement signal from the second flame detector 120 takes place in the same way as in the monitoring device 100 shown in FIG. 1 and will therefore not be explained in detail again.

In the monitoring device 200 the two-stage low-pass filter circuit 240 ensures that the measurement signals of both flame detectors 110 and 120 are evened out immediately after the common signal input 138.

The two Zener diodes ZD10 and ZD20 help ensure that, unlike with the monitoring device 100, with the monitoring device 200 it is also possible to detect a short circuit in the sensor between the common voltage supply line 132 and the common measurement signal line 134. To this end, the levels of the breakdown or Zener voltages of the two Zener diodes ZD10 and ZD20 are such that, in the event of a short circuit in the sensor, the input voltage at the common signal input 138 is higher than the diode voltage of the two Zener diodes ZD10 and ZD20. It should be borne in mind here that, in the event of a short circuit in the sensor, the voltage at the common signal input 138 is the full alternating voltage supplied by the voltage supplying device/transformer 130. By contrast, during normal operation of the monitoring device 200 there is at least a certain drop in the voltage over the UV cells (not shown) of the two flame detectors 110 und 120 when flames are burning, with the result that the voltage at the common signal input 138 is lower than the alternating voltage in the event of a short circuit in the sensor. Thus, in the event of a short circuit in the sensor, an alternating current signal is directed to the two transistors T10 und T20. The following output signals are generated as a result:

| | | |
|---|---|---|
| Output A1: | Low | –> main flame on |
| | High | –> main flame off |
| | Alt. voltage | –> short circuit in sensor |
| Output A2: | Low | –> pilot flame off |
| | High | –> pilot flame on |
| | Alt. voltage | –> short circuit in sensor |

It should be pointed out that FIG. 2 shows a circuit diagram for the monitoring device 200 that is suitable for a simulation program with which the following operating conditions can be simulated:

(A) The main flame is burning→Switch S1 is off (B) The pilot flame is burning→Switch S2 is off (C) Short circuit in sensor→Switch S3 is off The voltage signals, which are adjacent to outputs A1 and A2, can be shown for all possible operating conditions on the evaluation unit 270 depicted as an oscilloscope in the diagram.

Figure 3:
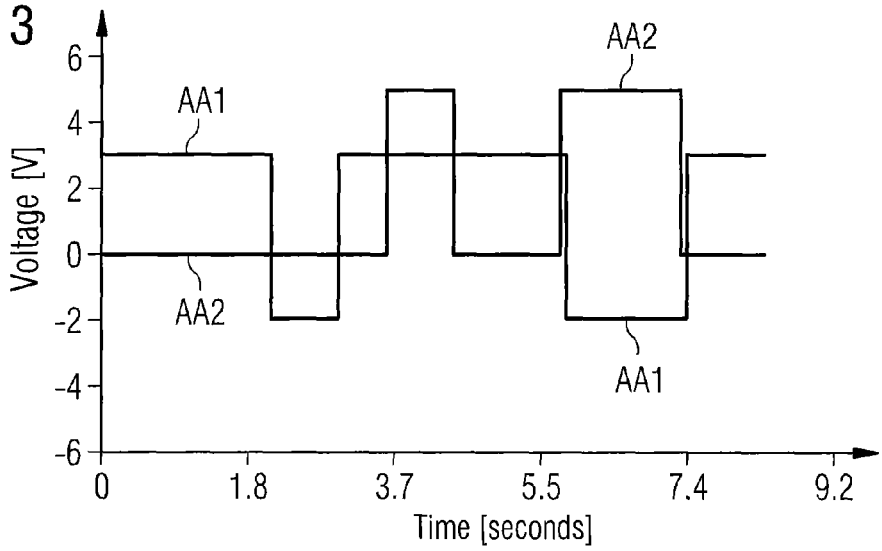
FIG. 3 shows the logical output signals, which are adjacent to the two outputs of the amplifier circuit shown in FIG. 2, for various flame constellations.

FIG. 3 shows the logical output signals, which are adjacent to the two outputs of the amplifier circuit shown in FIG. 2, for various flame constellations. Reference number AA1 designates the output signal assigned to output A1 shown in FIG. 2. Reference number AA2 designates the output signal assigned to output A2 shown in FIG. 2. For clarity's sake, the voltage of the output signal AA1 is shown as being shifted by –2 V.

As already explained above, the level of the output signal AA2 is "Low" when the pilot flame is out. If the level of the output signal is "High", the pilot flame is burning. The level of the output signal AA1 is also "High" when the main flame is out. If the level of the output signal AA1 is at "Low", the main flame is burning.

Figure 4:
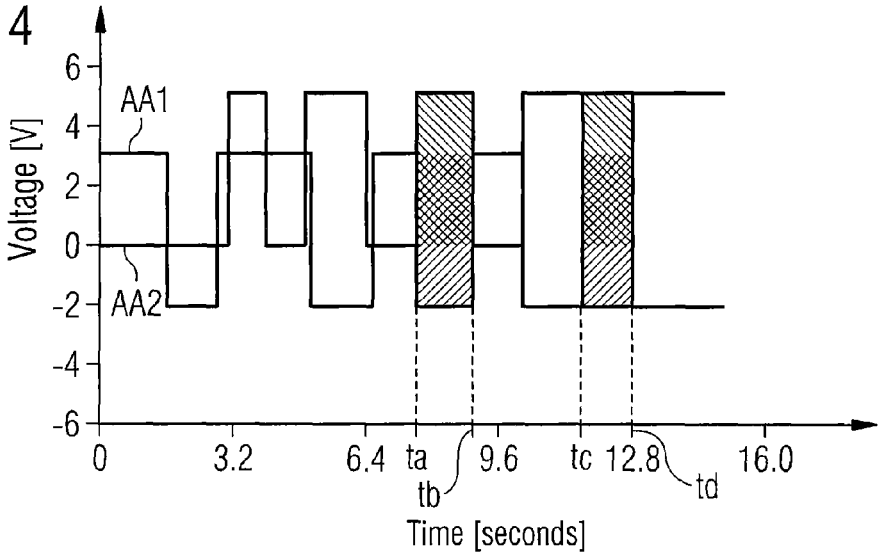
FIG. 4 shows the output signals, which are adjacent to the two outputs of the amplifier circuit, for various flame constellations, as well as for when there is a short circuit in the sensor between the common voltage supply line shown in FIG. 2 and the common measurement signal line.

FIG. 4 shows the output signals AA1 and AA2, which are adjacent to the two outputs A1 and A2 of the amplifier circuit 150, for various flame constellations, as well as for when there is a short circuit in the sensor between the common voltage supply line 132 shown in FIG. 2 and the common measurement signal line 134. Provided there is no short circuit in the sensor, the levels of the output signals AA1 and AA2 assume the values "Low" and "High" as described above (AA1 is also shown as being shifted by –2 V in FIG. 3).

In the exemplary scenario shown in FIG. 4 there is a short circuit in the sensor in two time windows. The first short circuit in the sensor starts at to and ends at tb, and the second short circuit in the sensor starts at tc and ends at td=12.8 seconds. As already described above, in both these time windows for the shortcuts in the sensor, the output signal AA1 and the output signal AA2 are alternating voltage signals and have the same frequency as the alternating voltage source 230 (see FIG. 2).

Figure 5:
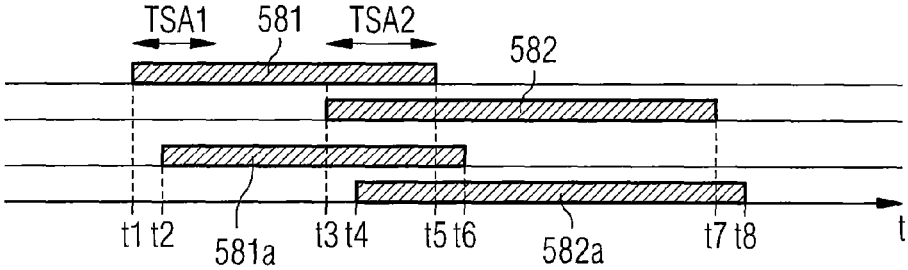
FIG. 5 shows a time chart of how a short circuit in the sensor between the common voltage supply line shown in FIG. 2 and the common measurement signal line can be detected during intermittent operation of a fuel combustion device that has a main flame and a pilot flame.

FIG. 5 shows a time chart of how a short circuit in the sensor between the common voltage supply line shown in FIG. 2 and the common measurement signal line can be detected during intermittent operation of a fuel combustion device that has a main flame and a pilot flame. The monitoring device 200 shown in FIG. 2, with the two Zener diodes ZD10 and ZD20, is not absolutely necessary for this. Rather, it is also possible, as explained below, for a short circuit in the sensor to be detected on the basis of a time correlation between a switching cycle of connected fuel feed valves and the resulting (flame) signals emitted at the outputs A1 and A2.

According to the exemplary embodiment shown here, a fuel feed valve for the main flame is opened at a point in time t1. The opened main flame valve is represented by the bar 581 in FIG. 5. Provided the monitoring device is working correctly and the main flame goes on as a result—which is assumed in the following—the presence of the main flame is indicated at the output A1 at a point in time t2. The corresponding flame signal is represented by the bar 581*a* in FIG. 5.

The time delay t2-t1 depends, among other things, on the time required for the fuel to be transported from the valve outlet to the location of the main flame. As a result, it is possible to calculate a maximum delay TSA1 for each fuel burning device, depending on its design, within which the main flame must go on. This delay TSA1 can be between 1 second and 10 seconds, depending on the design of the fuel burning device in question. However, if the first flame signal does not go on within this time span TSA1 starting at t1, then it can be assumed that the flame monitoring device is defective.

If the valve for the main flame is closed at a point in time t5 then, if the monitoring device is functioning correctly, it is expected that the flame signal 581*a* for the main flame goes off within a certain delay, at a point in time t6. If this is not the case, it can be assumed that there is a short circuit in the sensor.

The same applies to the opening (at a point in time t3) and closing (at a point in time t7) of the valve for the fuel feed for the pilot flame. In FIG. 5, the opened pilot flame valve is represented by the bar 582. If the monitoring device is functioning correctly, the flame signal 582*a* for the pilot flame will appear at a point in time t4 and disappear again at a point in time t8. It can also be assumed that there is a short circuit in the sensor if the flame signal 582*a* is still present even after the pilot flame valve has been closed for some time. In this case as well, if the monitoring device is functioning correctly, the time difference between t3 and t4 must not be greater than a characteristic delay TSA2 before ignition of the pilot flame Because, in principle, it has three different output signals ("Low", "High" and "Alternating voltage") that can be adjacent to either of the two outputs A1 and A2, the monitoring device 200 shown in FIG. 2 makes extensive fault monitoring possible. For example, faults in components of the evaluation circuit 150 can be reliably detected and the components in question actually identified. In this way, the requirements of, for example, standards EN230 and EN298 regarding behavior in the event of faults in components are fulfilled.

Table 1 below shows various faults in components of the monitoring device 200, together with the associated output signals at the outputs A1 and A2. The following abbreviations are used in Table 1:

C: Collector

B: Base

E: Emitter

L/H/A: State remains unchanged at "Low", "High" or "Alternating current signal", despite occurrence of fault in component AC: Alternating current signal SCS: Short circuit in sensor FS: Flame signal In the case of the output A1, "High" means that there is no flame signal from the main flame and "Low" means that there is a flame signal from the main flame.

In the case of the output A2, "High" means that there is a flame signal from the main flame and "Low" means that there is no flame signal from the main flame.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV*, 69 USPQ2d 1865 (Fed. Cir. 2004).

TABLE 1

| | Type of fault | Output A1 | Output A2 |
|---|---|---|---|
| R1 | Interruption | "High" | "Low" |
| R2 | Interruption | "High" | "Low" |
| R10 | Interruption | "High" | L/H/A |
| R11 | Interruption | "High" | L/H/A |
| R12 | Interruption | L/H/A | L/H/A |
| R13 | Interruption | "Low" | L/H/A |
| R20 | Interruption | L/H/A | "Low" |
| R21 | Interruption | L/H/A | "Low" |
| R22 | Interruption | L/H/A | L/H/A |
| R23 | Interruption | L/H/A | "Low" |
| R24 | Interruption | L/H/A | "High" |
| C1 | Interruption | AC (SCS) | AC (SCS) |
| | Short circuit | "High" | "Low" |
| C2 | Interruption | AC (SCS) | AC (SCS) |
| | Short circuit | "High" | "Low" |
| C10 | Interruption | L/H/A | L/H/A |
| | Short circuit | No FS if A2 active "High" | L/H/A |
| C20 | Interruption | L/H/A | L/H/A |
| | Short circuit | L/H/A | No FS if A1 active "Low" |
| D10 | Interruption | "High" | L/H/A |
| | Short circuit | L/H/A | L/H/A |
| D20 | Interruption | L/H/A | "Low" |
| | Short circuit | L/H/A | L/H/A |
| T10 | Interruption C | "High" | L/H/A |
| | Interruption B | "High" | L/H/A |
| | Interruption E | "High" | L/H/A |
| | Short circuit CE | "Low" | L/H/A |
| | Short circuit EB | "High" | L/H/A |
| | Short circuit CB | "Low" | L/H/A |
| T20 | Interruption C | L/H/A | "Low" |
| | Interruption B | L/H/A | "High" |
| | Interruption E | L/H/A | "High" |
| | Short circuit CE | L/H/A | "Low" |
| | Short circuit EB | L/H/A | "High" |
| | Short circuit CB | L/H/A | "Low" |

The invention claimed is:

1. A monitoring device to independently monitor a first flame and a second flame in a fuel combustion device, comprising:

a first flame detector, configured and arranged to receive a first batch of radiation, which is emitted by the first flame;

a second flame detector, configured and arranged to receive a second batch of radiation, which is emitted by the second flame;

a voltage supply device that is connected to the first and second flame detectors and is configured to apply an alternating voltage with a first half wave and a second half wave to the first and second flame detectors; and an evaluation circuit connected to the first and second flame detectors via a common signal input, wherein the first and second flame detectors are configured in such way that:

a first measurement signal that is present at the common signal input during the first half wave is indicative of an intensity of the first batch of radiation, and a second measurement signal that is present at the common signal input during the second half wave is indicative of an intensity of the second batch of radiation, and wherein the evaluation circuit is configured to evaluate the first measurement signal and the second measurement signal independently of one another.

2. The monitoring device as claimed in claim 1, further comprising:

a common voltage supply line that connects the voltage supplying device to both the first flame detector and the second flame detector; and/or a common measurement signal line that connects both the first flame detector and the second flame detector to the common signal input for the evaluation circuit.

3. The monitoring device as claimed in claim 1, wherein the first flame detector has a first electrically rectifying element, the second flame detector has a second electrically rectifying element, and the first and second rectifying elements are wired antiparallel to one another in relation to the voltage supplying device and to the common signal input.

4. The monitoring device as claimed in claim 3, wherein the first flame detector has a first radiation detector, the second flame detector has a second radiation detector, and at least one of the first and second radiation detectors is sensitive to ultraviolet radiation.

5. The monitoring device as claimed in claim 1, wherein the evaluation circuit has a filter circuit.

6. The monitoring device as claimed in claim 1, wherein the evaluation circuit has:

a first amplifier circuit to exclusively amplify the first measurement signal; and a second amplifier circuit to exclusively amplify the second measurement signal.

7. The monitoring device as claimed in claim 6, wherein the first and second amplifier circuits respectively produce first and second output signals, and the evaluation circuit has a data processing unit configured to detect a fault in an electronic component of the evaluation circuit based on the first output signal from the first amplifier circuit and the second output signal from the second amplifier circuit.

8. The monitoring device as claimed in claim 7, wherein the first amplifier circuit has a first diode on an input side, the second amplifier circuit has a second diode on an input side, the first and second diodes each have an anode side and a cathode side, the anode side of the first diode is connected to the common signal input, and the cathode side of the second diode is connected to the common signal input.

9. The monitoring device as claimed in claim 8, wherein the first diode is a first Zener diode and/or the second diode is a second Zener diode.

10. The monitoring device as claimed in claim 9, wherein at least one of the first and second Zener diodes has a breakdown voltage and:

(a) is operated within a voltage range that is lower than the breakdown voltage if there are fault-free connections of the first and second flame detectors to the voltage supplying device and to the common signal input, and (b) is operated within a voltage range that is higher than the breakdown voltage if a short circuit occurs between the voltage supplying device and the common signal input.

11. A method for independently monitoring presence of a first flame and a second flame in a fuel combustion device, comprising:

applying an alternating voltage with a first half wave and a second half wave, from a voltage supplying device to a first flame detector and a second flame detector;

receiving a first batch of radiation at the first flame detector, the first batch of radiation being emitted by the first flame;

receiving a second batch of radiation at the second flame detector, the second batch of radiation being emitted by the second flame;

directing a first measurement signal present during the first half wave from the first flame detector to a common signal input of an evaluation circuit, wherein the first measurement signal is indicative of an intensity of the first batch of radiation;

directing a second measurement signal present during the second half wave from the second flame detector to the common signal input of the evaluation circuit, wherein the second measurement signal is indicative of an intensity of the second batch of radiation; and monitoring the presence of the first flame and of the second flame at the evaluation circuit, based on the first measurement signal and the second measurement signal.

12. The method as claimed in claim 11, further comprising:

extinguishing the first flame, evaluating the first measurement signal; and considering hardware used for monitoring to be faulty if evaluation of the first measurement signal incorrectly indicates the presence of the first flame.

* * * * *